United States Patent [19]

Colgan, Jr.

[11] 4,191,936

[45] Mar. 4, 1980

[54] IMAGE PICKUP ASSEMBLY

[75] Inventor: John J. Colgan, Jr., Haddon Heights, N.J.

[73] Assignee: RCA Corporation, New York, N.Y.

[21] Appl. No.: 944,338

[22] Filed: Sep. 21, 1978

[51] Int. Cl.[2] ..... H01F 7/00

[52] U.S. Cl. ..... 335/210; 335/211

[58] Field of Search ..... 335/210, 211, 212, 213, 335/214

[56] References Cited

U.S. PATENT DOCUMENTS

| | | | |
|---|---|---|---|
| 3,921,110 | 11/1975 | Ishii | 335/210 |
| 4,039,986 | 8/1977 | Nakazawa et al. | 335/212 |
| 4,145,678 | 3/1979 | Takikawa | 335/211 |

*Primary Examiner*—George Harris

*Attorney, Agent, or Firm*—Eugene M. Whitacre; Paul J. Rasmussen; Robert L. Troike

[57] ABSTRACT

An image pickup tube is rigidly centered and mounted to a coil assembly by an adjustable split-ring clamp of hard plastic material mounted to the coil assembly. The split-ring clamp when adjusted for mounting compresses about the periphery of the faceplate or anti-halation disk extension of the tube to thereby provide a rigid mounting between the coil assembly and the tube. The rear portion of the coil assembly includes a yoke with a tapered inner surface. A split-ring wedge is forced between the tube and the rear portion of the yoke to rigidly support and center the rear portion of the tube.

5 Claims, 7 Drawing Figures

IMAGE PICKUP ASSEMBLY

BACKGROUND OF THE INVENTION

The present invention relates to an image pickup assembly and more particularly to a means for mounting a television camera tube in the center of a television camera yoke.

It is known that the geometrical distortion of an image on the image pickup tube is proportional in an amount to the square and the cube of its distance from the central axis of the deflection coil. The axis of the coil must be aligned with the axis of the image pickup tube and the optical axis within close tolerances. The optical axis of the camera and the axis of the coil are aligned with great precision but with the image pickup tube there is difficulty in aligning the picture pickup tube with the coil assembly due to the image pickup tube being manufactured with varying thicknesses and outer diameters. There is also the possibility of damage because the tube is made of glass. Further, if the cameras are slightly shocked in handling or new tubes installed it will cause misregistration and the camera must be recalibrated. Referring to U.S. Pat. No. 4,039,986 of Nakazawa et al, there have been a variety of approaches for mounting the tube in the coils. In FIG. 1 of the referenced patent of Nakazawa et al, elastic material such as gum rubber is used at two points along the tube (not at the remote ends) for mounting the tube. As illustrated in FIG. 2, of the above referenced patent, the elastic material may be embedded in a holder. The elastic material in the prior art has a minimum inner diameter that is smaller than the outer diameter of the pickup tube and depends upon the elasticity to absorb the irregularity of the outer diameter of the pickup tube. These elastic material pieces require a special shape and they are not only expensive to manufacture but are difficult to manufacture with high dimensional precision. This results in difficulty of alignment of the central axis of the coil assembly with that of the image pickup tube. Further, these elastic members are known to wear and the restoring forces may not completely return, making alignment difficult when replacing a new tube or when the camera is shocked in handling. Further as discussed in the referenced U.S. Pat. No. 4,039,986, the image pickup device is mounted using O-rings made of elastic material along the length of the tube. These O-rings have essentially the same problems as the other elastic materials. They are difficult to manufacture with high dimensional precision, are known to wear and the restoring forces may not completely return the tube when shocked in handling or when replacing a tube. An added disadvantage of prior art solutions is that the tubes are not securely held to prevent axial motion with respect to the yoke. This axial motion will cause focus and alignment problems.

SUMMARY OF THE INVENTION

Briefly, an improved means for mounting an image pickup tube in the center of a yoke coil assembly is provided by an adjustable clamping element of hard material mounted to the coil assembly. The clamping element is positioned about the periphery of the flat plate or disk at the target electrode end of the tube so when adjusted for mounting the clamping element compresses about the periphery of the plate. The opposite or stem end of the tube is centered and supported to the coil assembly.

DESCRIPTION OF A PREFERRED EMBODIMENT OF THE PRESENT INVENTION

Figure 1:
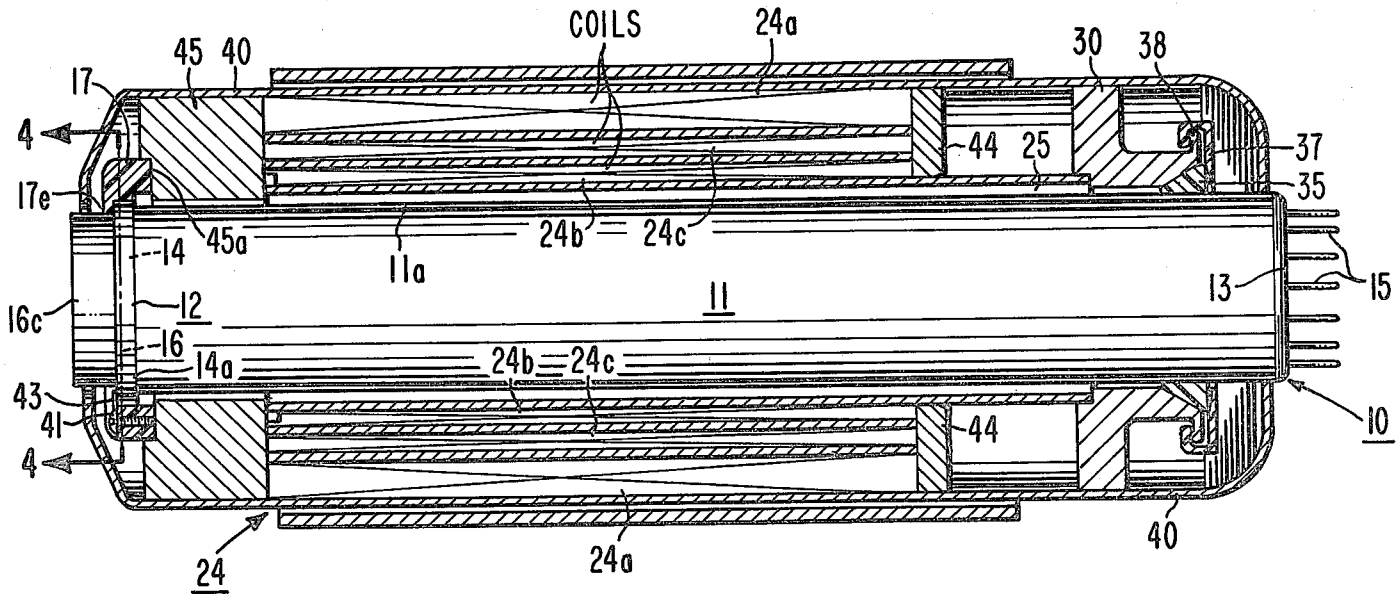
FIG. 1 is a sectional view showing an image pickup assembly according to one embodiment of the present invention.
Figure 2:
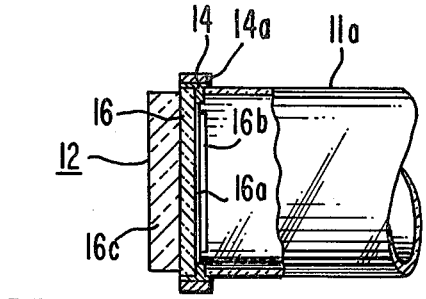
PRIOR ART Fig.2.
FIG. 2 is a sectional view illustrating how the faceplate of a pickup tube is mounted.

FIG. 1 is a sectional view of a color television camera yoke and pickup tube assembly. The pickup tube 10 includes an elongated evacuated envelope 11. The envelope 11 has a hollow tubular portion 11*a*, a front or target end 12, and a stem end 13. The hollow tube portion 11*a* is sealed at the stem end 13 by a glass seal formed for example by melting the glass. Lead-in pins 15 extend through the stem 13. The front or target end 12 includes a transparent faceplate 16 made of glass and a relatively thick anti-halation glass disk 16*c* (transparent glass) is fixed to the outside surface of the faceplate 16 and may be considered as part of the faceplate. This disk 16*c* is of slightly smaller diameter than the faceplate 16 and is centered with respect to the faceplate 16. The faceplate 16 supports on the inside of the tube a photoconductive target electrode (see FIG. 2). The photoconductive target electrode comprises a transparent conductive electrode coating 16*a* on the inner surface of the faceplate and a conductive film 16*b* on this coating. For more details see U.S. Pat. No. 2,984,759 of Vine. The faceplate 16 is an optically transparent glass and is produced by well-known lens grinding and polishing techniques. The seal between the faceplate and the tubular portion 11*a* is a glass-to-metal-to-glass seal. The metal seal between the glass faceplate 16 and the glass tubular portion 11*a* is an Indium sealing ring 14 which under pressure flows, by a plastic deformation, inward to form a seal between the faceplate 16 and the portion 11*a*. The Indium overlaps the transparent conductive coating 16*a*. The overlap of the transparent conductive coating 16*a* forms an electrical connection to the electrodes. The Indium provides a metallic rim 14 about the tube near the front end. A hard metal ring 14*a* surrounds this rim 14 as discussed in the referenced patent of Vine.

Figure 3:
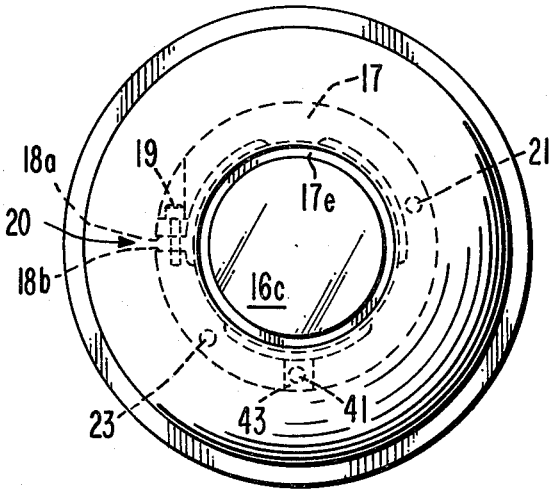
FIG. 3 is an end view of the front or target end of the assembly in FIG. 1.
Figure 6:
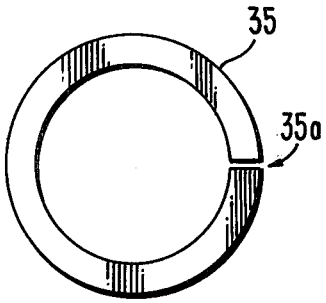
FIG. 6 is an end view of a tube wedge in FIG. 5.
Figure 4:
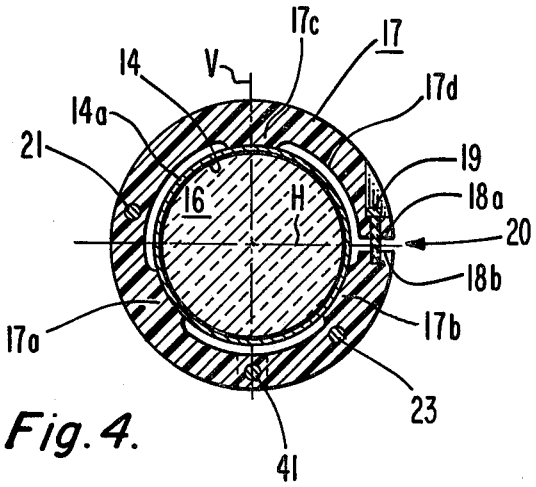
FIG. 4 is a cross-sectional view of the front end clamp taken in the 4—4 plane of FIG. 1.
Figure 7:
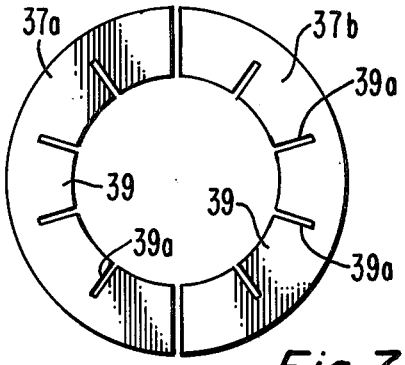
FIG. 7 is an end view of the centering support in FIGS. 1 and 5.

Referring to FIG. 1, the pickup tube 10 is mounted within a coil assembly 24 including an electromagnetic shield 40, surrounding the coils. The coil assembly 24 is a cylindrical member having aperture therethrough which is slightly greater than the maximum dimensions of the tube 10. The coil assembly 24 further includes focus coils 24*a* and deflection coils 24*b* and 24*c*. The deflection coils 24*b* and 24*c* are terminated at opposite ends by cylindrical blocks 45 and 44 of aluminum for example. Block 45 located at the forward end 12 of the assembly (the forward end meaning the end nearest the faceplate 16) has a groove 45*a* therein. An adjustable hard material split-ring clamp 17 of Delrin material is mounted in this groove 45*a* (see FIGS. 1, 3, and 4). The clamp 17 has an inner rim 17*e* that extends from the inner diameter surface of the clamp near the outboard end of the clamp that permits, when the clamp is adjusted for holding the tube 10, only the anti-halation disk 16*a* to extend through this rim 17*e*. This rim 17*e* provides a longitudinal end stop for the tube 10. The clamp 17 as shown in FIGS. 3 and 4, is a split-ring member having threads in one end 18*b* of the the ring. An adjustable screw 19 extends from opposite end 18*b* of the split-ring into the threads. The ends 18*a* and 18*b* are moved toward or away from each other by adjustment of screw 19 to thereby decrease or increase the space 20 between the ends and thereby decrease or increase the diameter of the ring. The clamp 17 includes three tube contact members 17*a*, 17*b*, and 17*c* as shown in the cross-section of FIG. 4. The tube contact members 17*a*, 17*b*, and 17*c* extend from the inner diameter of the ring toward the tube. These contact members 17*a*, 17*b*, and 17*c* are equally displaced about the inner surface 17*d* of the ring. The contact members 17*a* and 17*b* for the example illustrated in FIG. 4 are located below the horizontal line H through the center line of the tube and the contact member 17*c* is located above the horizontal line H and is centered with respect to the vertical axis V. The contact members 17*a* and 17*b* are equally spaced on opposite sides of the vertical axis V of the tube 10 as shown in FIG. 4 and the coil assembly. The contact members 17*a*, 17*b*, and 17*c* make contact with the hard metal ring 14*a* about the periphery of the faceplate 16. The clamping about the faceplate 16 rather than the hollow tube portion allows substantially greater compressional forces to be applied to the pickup tube to thereby permit greater rigidity. Also this same clamping may be about the anti-halation disk 16*c* which is an extension of the faceplate. The contact members 17*a*, 17*b*, and 17*c* may also extend from the rim 17*e* and make contact with the disk 16*c*. Further the faceplate 16 and antihalation disk 16*c* can be made to closer tolerances than the thickness of a tube to reduce the centering errors of the tube. Referring to FIG. 3, two screws 21 and 23 mount the clamp 17 to the block 45. These two screws mount the hard material clamp so that when the adjustable screw 19 is moved to close or to open the gap between the ends 18*a* and 18*b*, only the vertical axis contact member 17*c* moves and it moves only in a vertical direction. The screws 21 and 23 are located on opposite sides of the vertical axis with the one screw 23 below the horizontal line axis and the other screw only slightly above the horizontal axis and almost directly opposite the space 20 or split in the ring to act as a hinge. With this system the horizontal center of the tube is unchanged. The horizontal center of the tube is in the position determined by the contact members 17*a* and 17*b* which are not moved. Only the vertical centering is adjusted. When a tube is replaced the only tolerance that will have to be adjusted is the vertical centering. The vertical centering will vary with the tolerance of the outside diameter of the faceplate and its mounting to the hollow portion of the tube 10. The centering error will be one-half of the variation of the tube. For a 30 mm (millimeter) tube a maximum variation on the outside diameter 0.012 inches (0.304 mm), therefore, the maximum vertical centering error will be 0.006 inches (0.152 mm).

A ground connection to the metal ring 14*a* is provided via screw 41 which as illustrated in FIG. 1 extends through the clamp 17 to the block 45. A metal strap 43 is connected to the screw 41 and makes contact with the hard metal ring 14*a*.

The material of clamp 17 is an engineering plastic known as Delrin. Delrin is an acetal resin often used as a substitute for metal and sold by E. I. duPont de Nemours & Co. This material is a hard and temperature stable plastic material that behaves like steel. Metal is not used because this would act as a one turn transformer. Delrin is not an elastic material but has enough flexibility to close the ends of 18*a* and 18*b* under sufficient pressure as would a steel split-ring. This material does not flow as some plastics under heat but is relatively insensitive to the heat of the tube and will not cold flow (not lose dimensional stability under pressure).

The rear or stem support of the tube 10 consists of three parts illustrated in FIGS. 1, 5, 6, and 7. The three parts which provide centering and support are the rear yoke 30, a tube wedge 35, and a tube centering support 37. The rear yoke 30 is bonded to an electrostatic shield 25 (see FIG. 1) which is fixed to the deflection coils and block 44. The rear yoke 30 is made of an aluminum alloy material. The rear yoke 30 is a hollow cylinder with a tapered portion 31 of about 30 degrees at the inside surface thereof and an end flange portion 32. The flange portion 32 has a longitudinally extending rim 32*a*.

Figure 5:
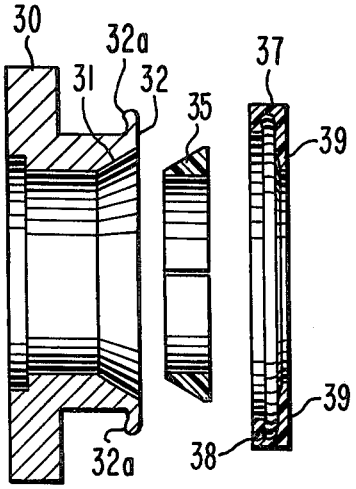
FIG. 5 is an exploded and cross-sectional view of the mounting assembly at the rear portion of the assembly in FIG. 1.

The tube wedge 35 is a tapered split-ring shim having a tapered outer diameter surface which when mounted faces and aligns with the taper of the tapered portion 31 of the rear yoke 30 as illustrated in FIGS. 1 and 5. This tube wedge 35 has a 30 degree taper. As illustrated in FIG. 5, the tube wedge has an inner diameter surface that is not tapered and the wedge has a gap 35*a*. The gap 35*a* allows the tube 10 to be centered in spite of the 0.024 inch (0.6 mm) variation in its diameter. The tube centering support comprises two half ring elements 37*a* and 37*b* which together form a ring of an inner diameter to permit the tube to pass therethrough and an outer diameter to pass over flange portion 32 of yoke 30. Each of the half ring elements 37*a* and 37*b* have cupped outer edges 38 which are adapted to fit over the flange portion 32 including the rim 32*a* of the rear yoke 30. The half ring elements 37*a* and 37*b* have narrow slots 39*a* therein extending from the inner surface of the ring to provide spring-like fingers 39, when the elements 37*a* and 37*b* are in place, to urge the wedge 35 between the rear yoke 30 and the tube 10. The elements 37*a* and 37*b* may be supported in a pivoting manner near one of the ends thereof to the rear yoke 30 so they may be swung out of position when removing the tube. The fingers 39 between the slots 39*a* urge the wedge 35 against the rear yoke portion 30. The tube centering support allows for the change in the longitudinal position as a diameter will change from tube to tube. This system provides essentially zero centering error in the rear of the tube and occupies less space than the other designs. The wedge 35 and the support elements 37*a* and 37*b* are of Delrin material.

What is claimed is:

1. An image pickup assembly comprising:

a cylindrical image pickup tube having a solid flat transparent plate at the front target electrode end of said tube, a coil assembly disposed around said tube, an adjustable clamping element mounted to said coil assembly about said tube, said adjustable hard material clamping element being positioned about the periphery of the said flat plate and adjusted when mounting to compresses about the periphery of said flat plate to provide a rigid mounting between the coil assembly and the tube, and rear support means located near the end opposite plate end of the tube when mounted for centering and supporting the tube in the coil assembly.

2. The combination of claim 1 wherein said clamping element includes a split or open ring with means for adjusting the gap spacing between the ends, said split ring includes two contact members extending from the inner diameter surface of the ring adapted to center the tube in one reference plane and a third contact member extending from the inner diameter surface of the ring to center the tube in a reference plane orthogonal said one reference plane.

3. The combination of claim 2 wherein said split ring is mounted to said coil assembly to be adjustable only in said orthogonal plane.

4. The combination of claim 3 wherein said coil assembly includes a yoke portion near said opposite end of said tube when mounted with a tapered inner surface and a flange portion and said rear support means includes a split ring wedge and a wedge support fitted about the tube, said split ring wedge having a tapered outer surface which matches with taper in the rear yoke and a split therein to allow the diameter of the ring to adjust for different tube diameters while keeping the tube centered in the coil assembly, and said wedge support having cupped edges and spring-like fingers, said cupped edges fitting about said yoke flange and said spring-like fingers forcing said wedge tightly between said tube and said yoke portion.

5. An image pickup tube assembly comprising:

an image pickup tube having a long tubular body with a circular flat transparent plate at the target end of said tube and a stem end with lead-in pins, a cylindrical coil assembly disposed about said pickup tube, an adjustable clamp mounted to the coil assembly at one end and disposed about the periphery of said plate, said clamp having three extending contact members, said clamp when adjusted moving only one of said contact members to compress about the periphery of said plate and thereby provide a rigid control of said tube, said coil assembly having a rear cylindrical yoke portion near the stem end of the tube having a tapered inner surface, and a split-ring wedge having tapered outer diameter matching that of said inner surface of said yoke and a gap spacing to allow for changes in tube diameter, said wedge forced between said tube and said yoke portion for centering and supporting the opposite end of said tube.

* * * * *